United States Patent [19]

Schwartz

[11] 4,088,167

[45] May 9, 1978

[54] HANDBAG WITH DETACHABLE HANDLES

[75] Inventor: Lawrence B. Schwartz, Fairfield, Conn.

[73] Assignee: Acricite Company, Inc., Bridgeport, Conn.

[21] Appl. No.: 729,168

[22] Filed: Oct. 4, 1976

[51] Int. Cl.[2] ..... A45C 13/26

[52] U.S. Cl. ..... 150/33; 150/12; 190/58 A; 190/57

[58] Field of Search ..... 150/12, 33; 190/57, 190/58 A; 16/110; 224/45 R, 45 P, 52

[56] References Cited

U.S. PATENT DOCUMENTS

| | | | |
|---|---|---|---|
| 154,283 | 8/1874 | Roemer | 224/52 |
| 1,127,556 | 2/1915 | Wellman | 224/45 |
| 1,271,928 | 7/1918 | Nelles | 150/12 |
| 1,374,126 | 4/1921 | Walter | 190/57 |
| 1,448,693 | 3/1923 | Magill | 150/12 |
| 2,513,040 | 6/1950 | Miller | 150/12 |
| 3,115,228 | 12/1963 | Louik | 190/57 |
| 3,790,050 | 2/1974 | Sullivan | 224/45 P |

FOREIGN PATENT DOCUMENTS

| | | | |
|---|---|---|---|
| 664,704 | 9/1928 | France | 150/33 |

*Primary Examiner*—Ro E. Hart
*Attorney, Agent, or Firm*—Buckles and Bramblett

[57] ABSTRACT

A handbag including an open top receptacle portion. A plurality of straps, each affixed at one end, are positioned along the periphery of the opening. The straps extend through slots in a pair of substantially planar handles. The free ends of the straps are secured in looped engagement with the handles by snap fasteners.

5 Claims, 6 Drawing Figures

Fig. 1.
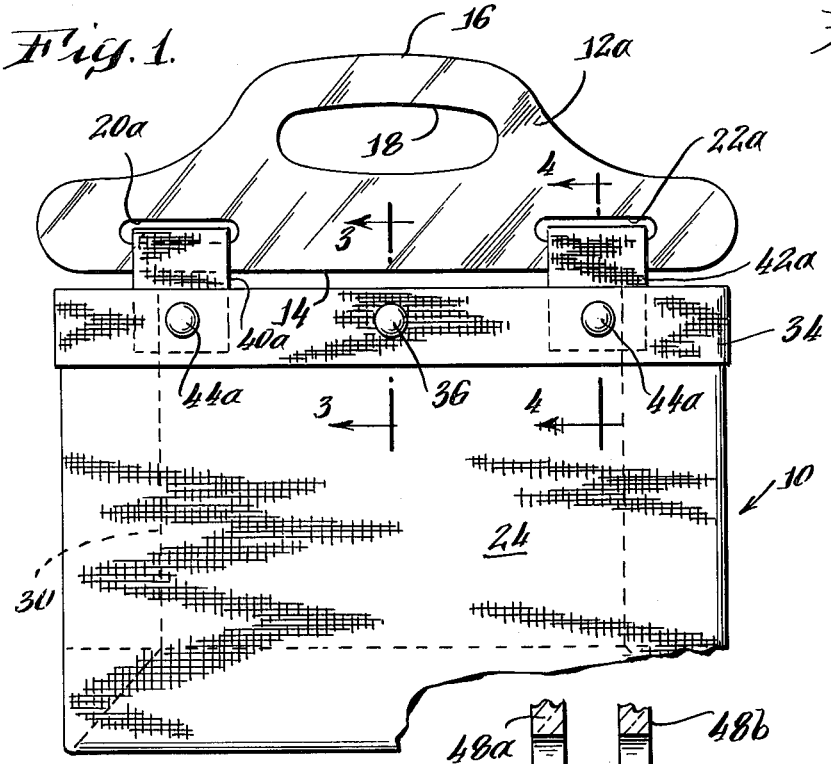
Fig. 2.
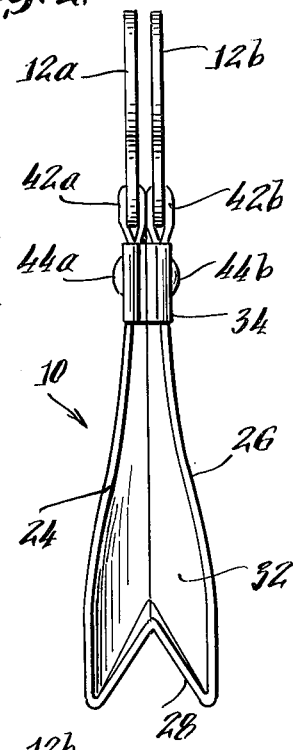
Fig. 6.
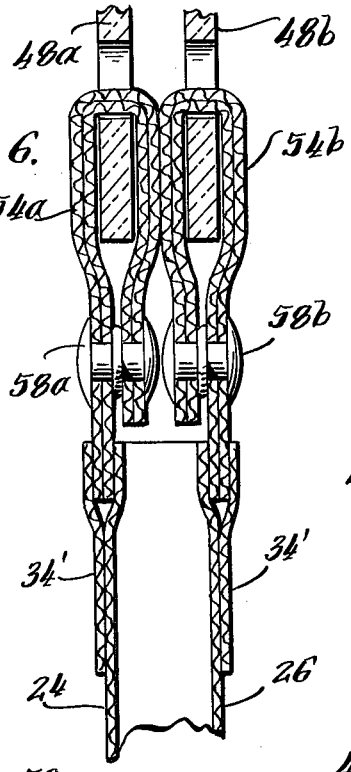
Fig. 4.
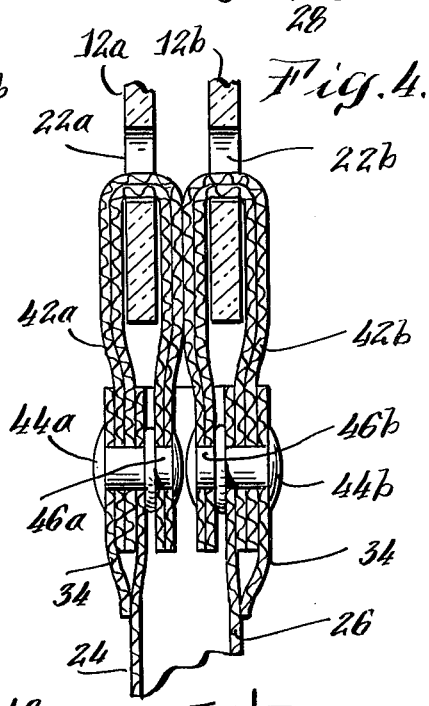
Fig. 3.
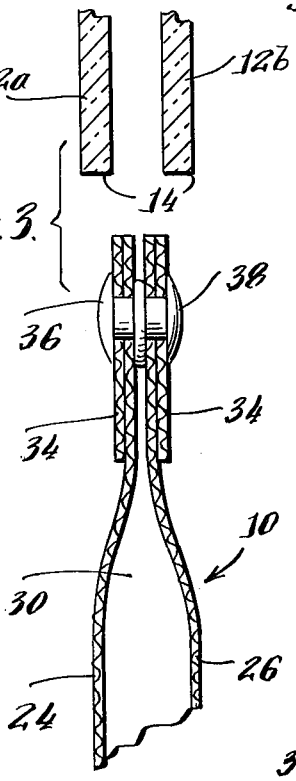
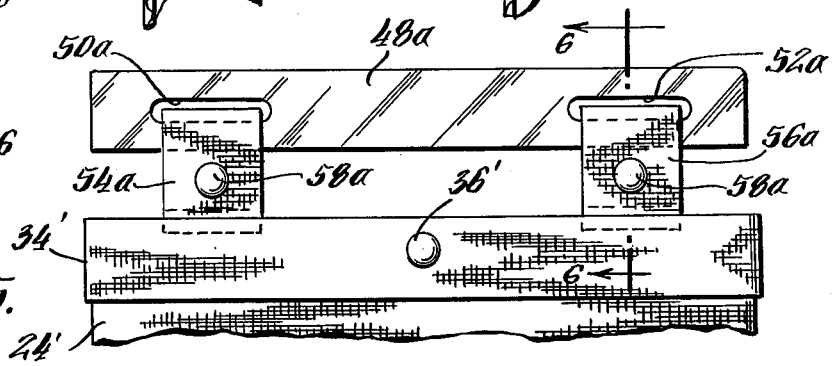
Fig. 5.

HANDBAG WITH DETACHABLE HANDLES

BACKGROUND OF THE INVENTION

This invention pertains to handbags and, more particularly, to ladies handbags having interchangeable handles. It is often desirable, for reasons of personal preference or color coordination for a lady to be able to change the shape of the handles of a handbag or, alternatively, to change the bag used with a particular handle. This may be especially true when the handles, as in accordance with one feature of this invention, are formed of a clear (or neutral shade) plastic material. Any of several bags of different colors or styles may then be selectively secured to the handles without concern as to color mismatching. There are some relatively complex constructions shown in the prior art for making somewhat similar substitutions. One, for example, will be found in U.S. Pat. No. 2,118,400 of Goldberg. Other pertinent disclosures may be found in U.S. Pat. No. 1,693,110 of Faistenhammer; U.S. Pat. No. 2,705,988 of Schultz; and U.S. Pat. No. 3,333,308 of Mack. None of these patents, however, disclose a construction as simple of concept as that proposed herein. It is, accordingly, the primary object of this invention to provide a means for rapidly and simply changing the style of handle of a particular handbag. Another object is to provide such a construction for simply and readily changing the bag affixed to a particular handle. Other objects, features and advantages will become apparent from the following description and appended claims.

SUMMARY OF THE INVENTION

A handbag comprising a flexible, open top receptacle portion having first and second opposed side panels. First and second substantially similar planar handle members are supplied, each defining at least two openings therethrough. First and second strap means are each secured by one end to each of the side panels in spaced relationship to one another and extend through respective openings in one of the handle members. Means are provided for selectively securing the other end of each of the strap means in looped engagement with one of the handle members through one of the openings.

BRIEF DESCRIPTION OF THE DRAWINGS

FIG. 1 is an elevational view of a handbag constructed in accordance with the present invention;

FIG. 2 is an end view of the handbag of FIG. 1;

FIG. 3 is an enlarged cross section taken substantially along the line 3—3 of FIG. 1;

FIG. 4 is an enlarged cross section taken substantially along the line 4—4 of FIG. 1;

FIG. 5 is a partial elevational view, similar to that of FIG. 1, but illustrating a modification of the invention;

FIG. 6 is an enlarged cross section taken substantially along the line 6—6 of FIG. 5.

DESCRIPTION OF THE PREFERRED EMBODIMENTS

With particular reference to FIGS. 1–4, there is illustrated a handbag in accordance with this invention comprising a receptacle portion 10, formed of a suitable material such as fabric, depending from a pair of identical planar, rigid handles 12*a*, 12*b*. Each of the handles has a substantially straight bottom edge 14 and a generally convex upper edge 16 and defines therebetween a finger opening 18. Aligned parallel with the bottom edge 14 are a paid of slots 20, 22.

In one modification of the invention, the receptacle 10 is formed from a single length of canvas-like material shaped to form a pair of side panels 24, 26 and a bottom 28. The ends of the receptacle portion are formed by a pair of end panels 30, 32. The top of the receptacle portion 10 is bounded by a peripheral band 34 stitched thereto. The top of the bag is closable by means of a conventional metal snap comprising a female portion 36 extending through the band 34 and side panel 24 and a male portion 38 extending through band 34 and side panel 26.

Stitched between the band 34 and the side panel 24 is one end of each of a pair of two ply straps 40*a*, 42*a*. Similar straps 40*b*, 42*b* are similarly stitched at one end between the band 34 and side panel 26. Extending through each of these secured ends of the straps 40, 42, as well as through the band 34 and the associated side panel 24 or 26, is a female snap member 44. A corresponding male snap member 46 is mounted on the free end of each of the straps 40, 42. As illustrated in FIGS. 1–4, the handling of this invention is shown with each of straps 40, 42 being looped through the slots 20, 22 formed in the handles, each strap being thereupon looped back upon itself and secured by the snaps 44. Bags of various styles and color schemes may be provided with suitably spaced and sized straps so as to be readily interchangeable and secured to the same handles. Alternatively, different handles of different styles may also be employed.

In FIGS. 5 and 6, there is illustrated a modified form of the invention wherein parts similar to those of FIGS. 1–4 are given similar reference numerals but with a prime (') attached. In this modification, a variant type of handle 48 is utilized which is in the form of a bar, defining similar slots 50*a*, 52*a* but not including a finger opening. In order to provide sufficient space to be easily grasped by the hand, the connecting straps 54, 56 are lengthened by changing the location of the female snaps 58 to a position above the mouth of the bag. The male snaps remain substantially unchanged and the spacing between the bag and the handle is thereby increased as shown in FIG. 5.

It is believed that the many advantages of this invention will now be apparent to those skilled in the art. It will also be apparent that a number of variations and modifications may be made in this invention without departing from its spirit and scope. Accordingly, the foregoing description is to be construed as illustrative only, rather than limiting. This invention is limited only by the scope of the following claims.

What is claimed is:

1. A handbag comprising: a flexible, open top receptacle portion having first and second opposed side panels; first and second substantially similar planar handle members, each defining at least two opeings therethrough; first and second strap means, each secured at one end to one of said side panels in spaced relationship to one another, to extend through respective openings in one of said handle members; third and fouth strap means, each secured at one end to the other of said side panels in spaced relationship to one another, to extend through respective openings in the other of said handle members; and means for releasably securing the other end of each of said strap means in looped engagement with one of said handle members through one of said openings.

2. The handbag of claim 1 wherein said openings are slots.

3. The handbag of claim 2 wherein said securing means are snap fasteners.

4. The handbag of claim 3 wherein said snap fasteners are positioned to extend through both of said straps and said side panels.

5. The handbag of claim 3 wherein said snap fasteners are positioned to extend through said straps above said receptacle portion.

* * * * *